US010718071B2

(12) United States Patent
Brandl et al.

(10) Patent No.: US 10,718,071 B2
(45) Date of Patent: Jul. 21, 2020

(54) SPINNING-MILL MACHINE AND A METHOD FOR OPERATING SLEEVE TRANSPORT DEVICES ON A SPINNING-MILL MACHINE

(71) Applicant: Maschinenfabrik Rieter AG, Winterthur (CH)

(72) Inventors: Sebastian Brandl, Boehmfeld (DE); Adalbert Stephan, Beilngries/Paulushofen (DE); Harald Widner, Ingolstadt (DE); Martin Zipperer, Beilngries (DE); Helmut Haunschild, Dietfurt (DE); Christian Kettner, Koesching (DE); Alexander Holzheimer, Ingolstadt (DE)

(73) Assignee: MASCHINENFABRIK RIETER AG, Winterthur (CH)

( * ) Notice: Subject to any disclaimer, the term of this patent is extended or adjusted under 35 U.S.C. 154(b) by 75 days.

(21) Appl. No.: 15/933,468

(22) Filed: Mar. 23, 2018

(65) Prior Publication Data

US 2018/0274133 A1 Sep. 27, 2018

(30) Foreign Application Priority Data

Mar. 23, 2017 (DE) ..... 10 2017 106 319

(51) Int. Cl.
*D01H 9/18* (2006.01)
*B65H 67/06* (2006.01)

(52) U.S. Cl.
CPC ..... *D01H 9/18* (2013.01); *B65H 67/068* (2013.01); *B65H 2701/31* (2013.01)

(58) Field of Classification Search
CPC ..... B65H 67/068; D01H 9/18; D01H 9/182
See application file for complete search history.

(56) References Cited

U.S. PATENT DOCUMENTS

2017/0342604 A1 11/2017 Pohn et al.

FOREIGN PATENT DOCUMENTS

| | | | |
|---|---|---|---|
| DE | 28 16 418 | A1 | 10/1979 |
| DE | 39 08 462 | A1 | 2/1990 |
| DE | 10 2004 055 483 | A1 | 6/2005 |
| EP | 0 262 726 | A2 | 4/1988 |
| WO | WO 2016/102456 | A1 | 6/2016 |

OTHER PUBLICATIONS

Machine Translation of WO 2016/102456 A1, Jun. 30, 2016. (Year: 2016).*
EPO Search Report, dated Jun. 19, 2018.
German Search Report, dated Nov. 17, 2017.

* cited by examiner

*Primary Examiner* — William E Dondero
(74) *Attorney, Agent, or Firm* — Dority & Manning, P.A.

(57) ABSTRACT

A spinning-mill machine includes a plurality of cross-winding devices arranged next to each other and in sections in a longitudinal direction along opposite machine sides of the spinning-mill machine, each cross-winding device configured to wind yarn onto a sleeve. A plurality of sleeve stacks are arranged with each machine side and are configured to stockpile empty sleeves. A plurality of sleeve transport devices are configured alongside the cross-winding devices of the machine side, wherein each of the sleeve stacks has one of the sleeve transport devices operationally associated therewith to deliver the sleeves from the sleeve stack to the cross-winding devices.

8 Claims, 4 Drawing Sheets

SPINNING-MILL MACHINE AND A METHOD FOR OPERATING SLEEVE TRANSPORT DEVICES ON A SPINNING-MILL MACHINE

FIELD OF THE INVENTION

The present invention relates to a spinning-mill machine with a multiple number of cross-winding devices arranged next to each other and on two machine sides located in the longitudinal direction of the spinning-mill machine, each of which is provided for winding yarn onto sleeves. The cross-winding devices are collected into a multiple number of sections. A multiple number of sleeve stacks are provided for stockpiling of empty sleeves. A sleeve transport device is arranged along the cross-winding devices for supplying the cross-winding devices with empty sleeves from the sleeve stack. A method is also provided for operating sleeve transport devices on a spinning-mill machine.

BACKGROUND

Modern textile machines, such as (for example) open-end rotor spinning machines or winding machines, are able to wind different yarns onto bobbins at their many work stations. For the individual varying yarns, it is frequently necessary or at least helpful for the later recognition of the respective yarn if different sleeve types are provided on the textile machine. In this case, one yarn type is wound onto a specific sleeve, which is particularly marked in a particular color.

DE 39 08 462 A1 discloses a spinning machine with a multiple number of spinning units arranged next to each other, each of which is provided with winding devices for the winding of cross-wound bobbins. Movable bobbin changers, each of which carries a stack for empty sleeves with it, are arranged between the spinning units and a sleeve loading station. On each machine side, there are two bobbin changers, whereas each bobbin changer serves one machine half.

However, the disadvantage here is that sleeves from a stack cannot be transported over the entire length. Accordingly, the provision of the different sleeve types must take place in each stack, which is highly complex.

SUMMARY OF THE INVENTION

Thus, a task of the present invention is to provide a spinning-mill machine, which is able to store different sleeve types in a stack and to transport them as needed to a corresponding work station with the shortest possible transport time. Additional objects and advantages of the invention will be set forth in part in the following description, or may be obvious from the description, or may be learned through practice of the invention.

The tasks are achieved with a spinning-mill machine with the characteristics described and claimed herein.

The spinning-mill machine in accordance with the invention features a multiple number of cross-winding devices arranged next to each other and on two machine sides located in the longitudinal direction of the spinning-mill machine, each of which is provided for winding yarn onto sleeves. The cross-winding devices are collected into a multiple number of sections. In each section, for example, 8 or 10 cross-winding devices are arranged on each machine side. The spinning-mill machine also features one or more sleeve stacks, which serve to stockpile empty sleeves. A sleeve transport device arranged along the cross-winding devices serves to supply the cross-winding devices with empty sleeves from the sleeve stack.

In accordance with the invention, multiple sleeve stacks are arranged on each machine side, and each sleeve stack is allocated with its own stationary sleeve transport device. Thus, on the entire double-sided machine, there are at least four sleeve stacks in which the sleeves are stored. Different sleeve types can be stored in each sleeve stack, whereas, as needed, a suitable sleeve is removed from the stack and is transferred to the stationary sleeve transport device. The stationary sleeve transport device then conveys the corresponding sleeve to the cross-winding device on which the sleeve is needed or, with appropriate equipment of the machine, also in an intermediate stack, which is provided at a station of the machine side.

The stationary sleeve transport device has the advantage that it is easy to use and control. This may comprise a conveyor belt on which the sleeve to be transported is placed or a transport chain, optionally with trays or hooks, with which the sleeve is transported to the requesting work station or the intermediate stack. Due to the stationary arrangement, a complex drive control of a movable bobbin changer for transporting the sleeves is avoided. The bobbin changer can perform its more demanding activity of changing the full bobbin with the empty sleeve with greater speed, thus increasing the productivity of the machine. The supply of the correct sleeve at the corresponding cross-winding device or work station, as the case may be, can take place with the stationary sleeve transport device within a period of time that is very short.

By means of appropriate, known devices, such as grippers on the cross-winding devices or work stations, as the case may be, or intermediate storage devices, the sleeves are removed from the sleeve transport device. If a single sleeve storage device is provided on each cross-winding device, the corresponding sleeve is removed from the allocated cross-winding device directly from the single sleeve storage device, provided that such cross-winding device requires the corresponding type of sleeve. Otherwise, the sleeve is removed from the sleeve stack, as described above, placed on the sleeve transport device and brought to the winding station at which it is currently needed. If a multiple sleeve storage device is provided, different sleeves are stored on an intermediate basis therein. These can either be of the same type, such that, in a multiple number of multiple sleeve storage devices distributed along the machine, the appropriate sleeve is available. The sleeves can be stored therein in a sorted manner, and placed on the transport device if the corresponding sleeve is needed. It is also possible that, in the multiple sleeve storage device, a multiple number of different sleeve types are stored; these are selected with a corresponding need and placed on the sleeve transport device.

Preferably, each sleeve stack is allocated exclusively to a predetermined machine side for stockpiling empty sleeves for such machine side. Thus, the design of the sleeve transport device is particularly simple, since it only needs to run in a straight line, and the sleeve does not need to be taken to the other machine side. Since, in many cases, the different sleeve types will be subdivided according to the machine sides, the equipping of the sleeve stacks can often be carried out on a sorted basis in a simple manner. In addition, the sleeve stacks can also stockpile the sleeves in a chaotic manner, and transport the respective sleeve type to the work station with an appropriate selection system.

It is particularly advantageous if the sleeve transport device is a conveyor belt arranged in a stationary position along the cross-winding devices. The conveyor belt is inexpensive to manufacture and is a proven means for transporting sleeves. It is particularly excellent for the straight-line transport of the sleeves.

If, in an advantageous manner, the sleeve transporting device, in particular the conveyor belt, can be reversibly driven, sleeves can be transported from the sleeve stack or from an intermediate storage device in both directions. This further increases the flexibility of the system. The request of a corresponding sleeve can accordingly take place in such a manner that it is sent from the sleeve stack that is closest to the requesting work station. It is also possible that, with a sorted storing in the stacks, the sleeve is sent from the stack that features the requested sleeve type. Given the reversible operation, the start of the transport of a sleeve with the first sleeve transport device and a continuation of the transport of the sleeve with the second sleeve transport device can take place.

In a preferred design of the invention, the sleeve transport devices of each machine side run parallel next to each other or one above the other. Thus, the handling of the sleeves for placement on the sleeve transport device or for removal from the sleeve transport device is particularly easy to implement, regardless of whether the sleeve is to be transported with one or the other sleeve transport device.

If sleeve transport devices allocated to the individual sleeve stacks are preferably arranged along only a part, in particular half, of the cross-winding devices of one machine side, and they complement each other up to the entirety of the cross-winding devices of one machine side, the entire machine side is supplied with sleeves with the individual sleeve transport devices. The split in the longitudinal direction of the machine is more cost-effective to produce than two sleeve transport devices that run in parallel.

Advantageously, the multiple sleeve stacks are aligned in a manner parallel to the machine side. This facilitates the handling and loading of the sleeves from the sleeve stack. In addition, the installation space of the machine is reduced and the allocation of the single sleeve stacks to the individual machine sides is facilitated. Overall, this increases the capacity of the sleeve stacks, since they cling to the machine along the machine side, and thus a multiple number of sleeve stacks can be made available.

If, in an advantageous embodiment of the invention, multiple sleeve stacks are arranged next to each other on each machine side, the capacity of the sleeves provided is thereby markedly increased compared to a front-side arrangement of the sleeve stacks. Thus, significantly more sleeves can be stacked. Thus, the mostly manually performed equipping of the sleeve stacks with sleeves can be carried out with a high degree of efficiency, since, given the high capacity, a re-equipping process must take place only rarely.

Preferably, the multiple sleeve stacks are arranged in the area of supply units of the spinning-mill machine, in particular on the drive frame, the intermediate frame or the end frame of the respective machine side. Thus, the sleeve stacks can be distributed along the machine and, as a whole, bring about a shortening of the feeding length of the spinning-mill machine.

If, in an advantageous design, the sleeve stack features a transfer station for transferring a sleeve to the sleeve transport device, the sleeve transport device can very easily take over sleeves from the sleeve stack and convey them to the corresponding sleeve storage devices or work stations, as the case may be.

Advantageously, the sleeve storage device is provided with a receiving and/or dispensing device to be able to receive or dispense the sleeves from or to the sleeve transport device. Thus, the sleeve transport device can be kept free for the transport of other sleeves and is not blocked by the sleeves stored on an intermediate basis in the sleeve storage devices.

A method in accordance with the invention is used to operate sleeve transport devices on a spinning-mill machine as described above, which features a multiple number of cross-winding devices arranged next to each other and on two machine sides located in the longitudinal direction of the spinning-mill machine, on each of which yarn is wound onto sleeves. The sleeve transport devices can be reversibly driven. The sleeve transport devices allocated to the individual sleeve stacks are arranged along a part, in particular half, of the cross-winding devices of one machine side, and supplement each other up to the entirety of the cross-winding devices on one machine side. A first sleeve transporting device is driven in the direction away from the first sleeve stack allocated to it, in order to supply the first cross-winding devices allocated to it with sleeves from the first sleeve stack. A second sleeve transport device adjacent to the first sleeve transport device and allocated to the other, second cross-winding devices is driven in the direction of the second sleeve stack allocated to it. This makes it possible to supply the second cross-winding devices with sleeves from the first sleeve stack.

Through a corresponding reversal of the transport, it is thus also made possible that the sleeve from the second sleeve stack is first given to the second sleeve transport device, and conveyed to the beginning of the first sleeve transport device, and taken over there and further conveyed by the first sleeve transport device. Thus, the two sleeve transport devices, which cover only a part of the textile machine, are able to transport sleeves from both the one and from the other stack to each of the cross-winding devices or work stations, as the case may be.

Preferably, the sleeve transported with the first sleeve transport device is transferred to the adjacent second sleeve transport device and further transported in the direction of transport of the first sleeve transport device. Thus, a more rapid transport along all of the cross-winding devices is possible. The transfer can take place, for example, through a corresponding coordinated drive control of the two sleeve transport devices.

The device and the method in accordance with the invention are formed in accordance with the preceding description, whereas the specified characteristics can be present individually or in any combination.

BRIEF DESCRIPTION OF THE DRAWINGS

Further advantages of the invention are described in the following embodiments. The following is shown.

DETAILED DESCRIPTION

Figure 1:
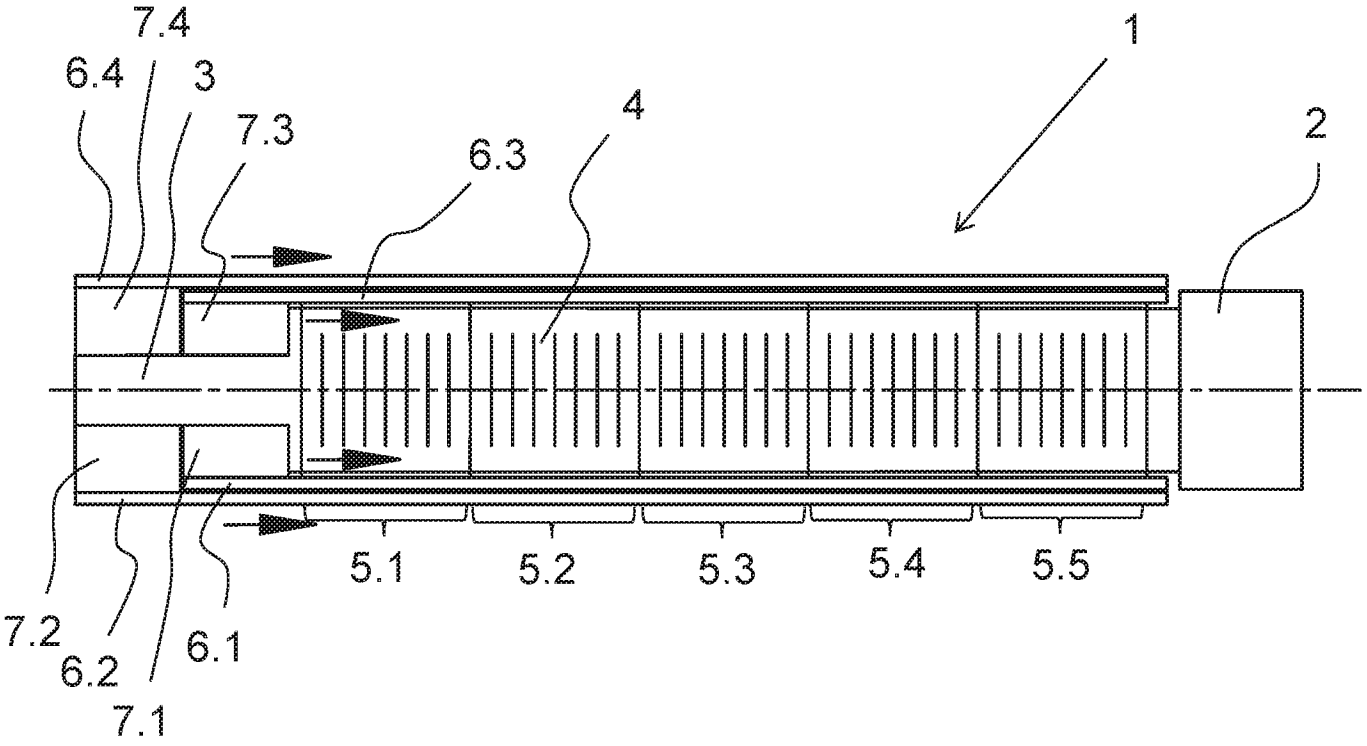
FIG. 1 is a spinning-mill machine with a multiple number of sleeve stacks on one machine end and, in each case, two sleeve transport devices per machine side.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

With the following description of the illustrated alternative embodiments, the same reference signs are used for characteristics that are identical and/or at least comparable in their arrangement and/or mode of action compared to the other illustrated embodiments. To the extent that such are not described once again in detail, their designs and/or modes of action correspond to the designs and modes of action of the characteristics described above.

FIG. 1 shows a top view of a spinning-mill machine 1 shown in outline, for example an open-end rotor spinning machine or a winding machine. The spinning-mill machine 1 features a drive frame 2 and an end frame 3, which are respectively arranged at the end of the spinning-mill machine 1. The spinning-mill machine 1 features two machine sides in the longitudinal direction, on which a multiple number of cross-winding devices 4 are arranged between the drive frame 2 and the end frame 3. For reasons of clarity, only one of the cross-winding devices 4 is provided with a reference sign. The multiple number of cross-winding devices 4 is collected into sections 5.1 to 5.5. In each section 5.1 to 5.5, a specific number, such as eight cross-winding devices 4 are arranged on each machine side. In each of the cross-winding devices 4, a holder (not shown here) for a sleeve is provided, on which a yarn is wound cross-wise. Depending on the yarn type, a different sleeve type is required. This is necessary or at least helpful in order to, later on, be able to more easily identify the yarn type that is located on the sleeve, if the bobbin is no longer located on the cross-winding unit 4.

Along the multiple number of cross-winding devices 4, two sleeve transport devices 6.1, 6.2 or 6.3, 6.4, as the case may be, are arranged on each side of the spinning-mill machine 1. In the present embodiment, each of the sleeve transport devices 6.1 to 6.4 is formed as a conveyor belt, on which sleeves are placed and transported to a predetermined destination. The sleeves are located in a large number in a multiple number of sleeve stacks 7.1 to 7.4. In the embodiment of FIG. 1, two sleeve stacks 7.1 and 7.2 or 7.3 and 7.4, as the case may be, are arranged in the end frame 3 on each machine side. The two sleeve stacks 7.1 and 7.2 or 7.3 and 7.4, as the case may be, are arranged one behind the other in the longitudinal direction of the machine. As a result, they cling closely to the spinning-mill machine 1, and thus require little installation space. Due to the division on each machine side into two sleeve stacks 7.1 and 7.2 or 7.3 and 7.4, as the case may be, the system is even more flexible. A sorted stacking of the sleeves is possible, such that, by such four existing sleeve stacks 7.1 to 7.4 (for example), four different sleeve types can be stacked. In terms of control technology, the transmission of the sleeves to the corresponding cross-winding devices 4 can take place very easily, since the sleeve type in which the sleeve stacks 7.1 to 7.4 is located is known.

In the present embodiment, the sleeve transport devices 6.1 to 6.4 have a single direction of transport in the direction of the arrow. This means that the sleeves are removed from the sleeve stacks 7.1 to 7.4, transferred to the sleeve transport device 6 and moved by it in the direction of the arrow.

Each of the sleeve transport devices 6.1 to 6.4 extends along all of the cross-winding devices 4 or sections 5.1 to 5.5, as the case may be, and is allocated to a specific sleeve stack 7.1 to 7.4. Thus, each sleeve, which is arranged in one of the sleeve stacks 7.1 to 7.4, can be supplied to any work station or cross-winding station 4, as the case may be, on its machine side.

Depending on the yarn type on the corresponding cross-winding device 4, a sleeve type is requested. The control device of the sleeve transport devices 6.1 to 6.4 is designed in such a manner that the sleeve is placed on the sleeve transport device 6 from the sleeve stack 7.1 to 7.4, in which the requested sleeve type is located.

Figure 2:
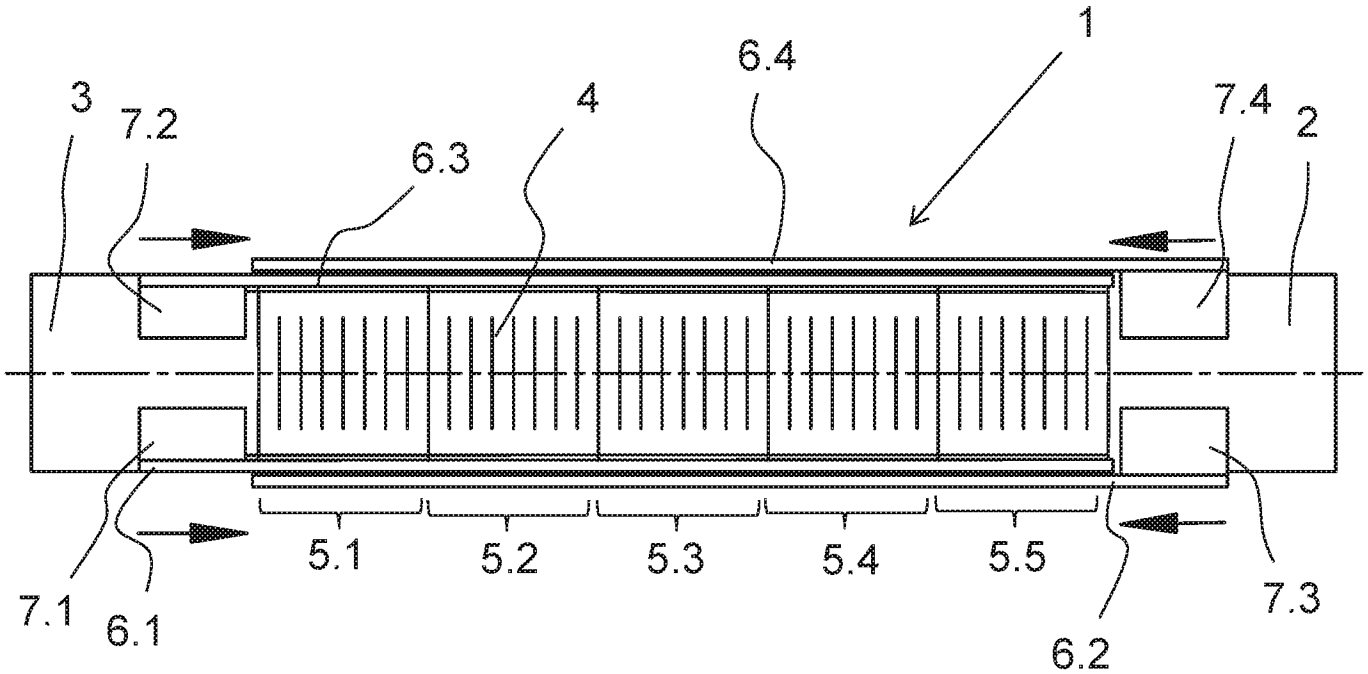
FIG. 2 is a spinning-mill machine with a multiple number of sleeve stacks on both machine ends and, in each case, two sleeve transport devices per machine side.

The illustration of FIG. 2 also shows a spinning-mill machine 1 in a top view and in a sketched illustration. It essentially corresponds to the arrangement of the spinning-mill machine 1 of FIG. 1. In this case, a difference is that the sleeve stacks 7.1 to 7.4 are distributed at the drive frame 2 and the end frame 3. Thus, the supply of sleeves takes place from both ends of the spinning-mill machine 1. In turn, each of the sleeve transport devices 6.1 to 6.4 extends along all of the cross-winding devices 4 of one machine side. The two sleeve transport devices 6.1 and 6.2 or 6.3 and 6.4, as the case may be, run parallel to each other. Here, they are next to each other; that is, they are shown horizontally relative to each other. Alternatively, they may be arranged one above the other; that is, vertically relative to each other. As in the case of FIG. 1, each cross-winding station can be loaded with sleeves by two sleeve transport devices 6.1 and 6.2 or 6.3 and 6.4, as the case may be. With a sorted storage of the sleeves in the sleeve stacks 7.1 to 7.4, two different yarns can be wound on each machine side. Of course, it is also possible that several sleeve types are stored in a sleeve stack 7.1 to 7.4, and thus significantly more different yarns can be wound. The selection of the required sleeve must then be made in the individual sleeve stacks 7.1 to 7.4.

The cross-winding device 4 is supplied by the sleeve stacks 7.1, 7.2 or 7.3, 7.4, as the case may be, arranged on the drive frame 2 and the end frame 3. If the machine is very long, it may be useful that one or more sleeve storage devices (not shown), in which the sleeves can be stored on an intermediate basis, are arranged along the machine, before being required at the cross-winding station 4. Thus, the delivery of the sleeve to the cross-winding station 4 can be done even more rapidly. Such intermediate storage devices can also be used in the other embodiments of the invention.

Figure 3:
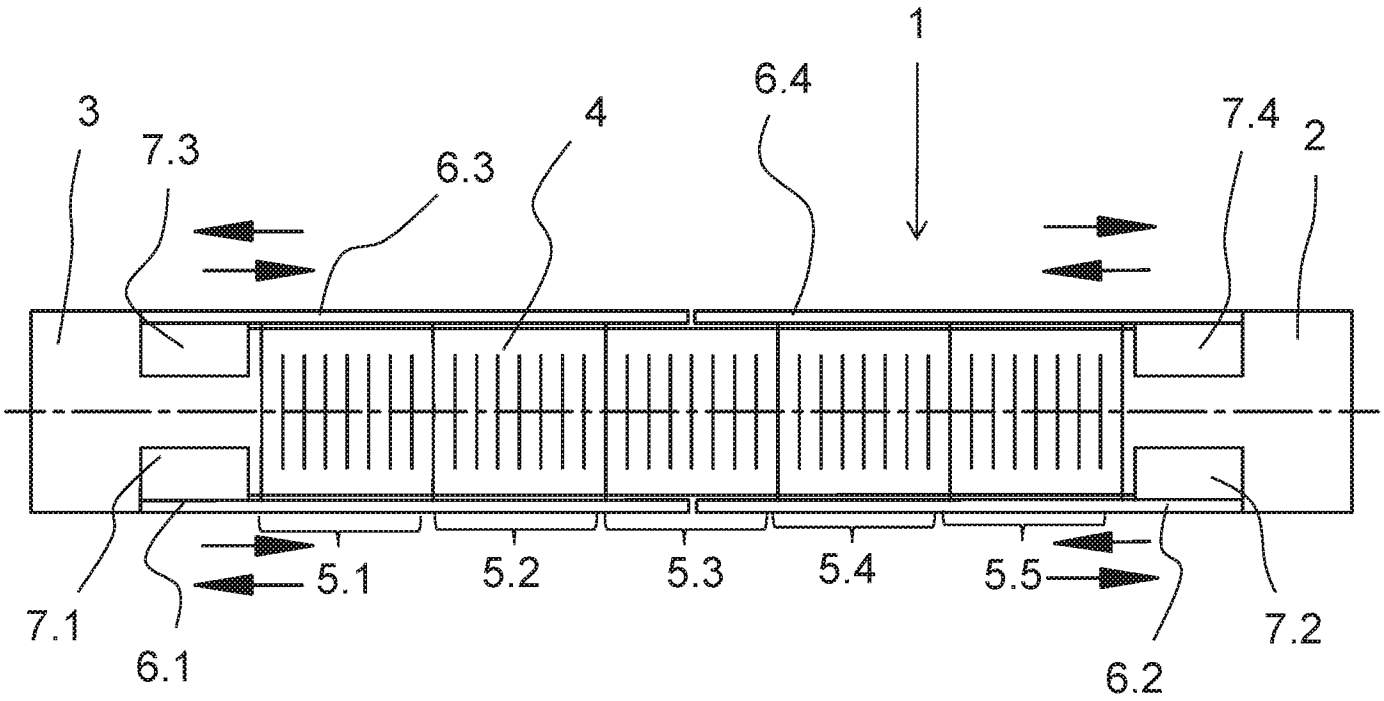
FIG. 3 is a spinning-mill machine with a multiple number of sleeve stacks on both machine ends and, in each case, two sleeve transport devices per machine half.

FIG. 3 shows a spinning-mill machine 1, which has a similar construction to the spinning-mill machine 1 of FIG. 2. With the design of FIG. 3, the arrangement of the sleeve transport devices 6.1 and 6.2 or 6.3 and 6.4, as the case may be, is varied. Two of the sleeve stacks 7.1, 7.3 are arranged on the end frame 3 of the spinning-mill machine 1, while the other two sleeve stacks 7.2, 7.4 are arranged on the drive frame 2. The sleeve transport devices 6.1 and 6.2 or 6.3 and 6.4, as the case may be, extend only over half of one machine side. Each sleeve transport device 6.1 and 6.2 or 6.3 and 6.4, as the case may be, is allocated to one of the sleeve stacks 7.1, 7.2 or 7.3, 7.4, as the case may be, and one machine side.

It can be provided that the sleeve transport devices 6.1 to 6.4 can transport in only one direction. In this case, each sleeve stack 7.1 to 7.4 supplies only one quarter of the machine with sleeves. However, in another design, it can also be provided that each sleeve transport device 6.1 to 6.4 can transport sleeves in both directions. In this case, the control of the sleeve transport devices 6.1 to 6.4 can take place in such a manner they are operated concurrently, and thus a transfer of the sleeve from one sleeve transport device 6.1, 6.3 to the other sleeve transport device 6.2, 6.4, and vice versa, can take place. If the sleeve transport devices 6.1 to 6.4 are operated in this manner, all of the cross-winding stations 4 on one machine side can be supplied with sleeves by both sleeve stacks 7.1, 7.2 or 7.3, 7.4, as the case may be. Accordingly, the direction of transport of the sleeve transport device 6 is indicated by arrows pointing in both directions. Thus, on the one hand, a sleeve can be transported from the sleeve stack 7.1 in the direction of the sleeve stack 7.2 and, on the other hand, a sleeve can be transported from the sleeve stack 7.2 in the direction of the sleeve stack 7.1. The same applies to the opposite machine side by analogy.

This arrangement can be more favorable in terms of space requirements and allows additional sleeve stacks, similar to those shown in FIG. 1 and FIG. 2, to be arranged on the spinning-mill machine 1 following the respective sleeve stack. Thus, the capacity of the stackable sleeves is even more expandable.

Figure 4:
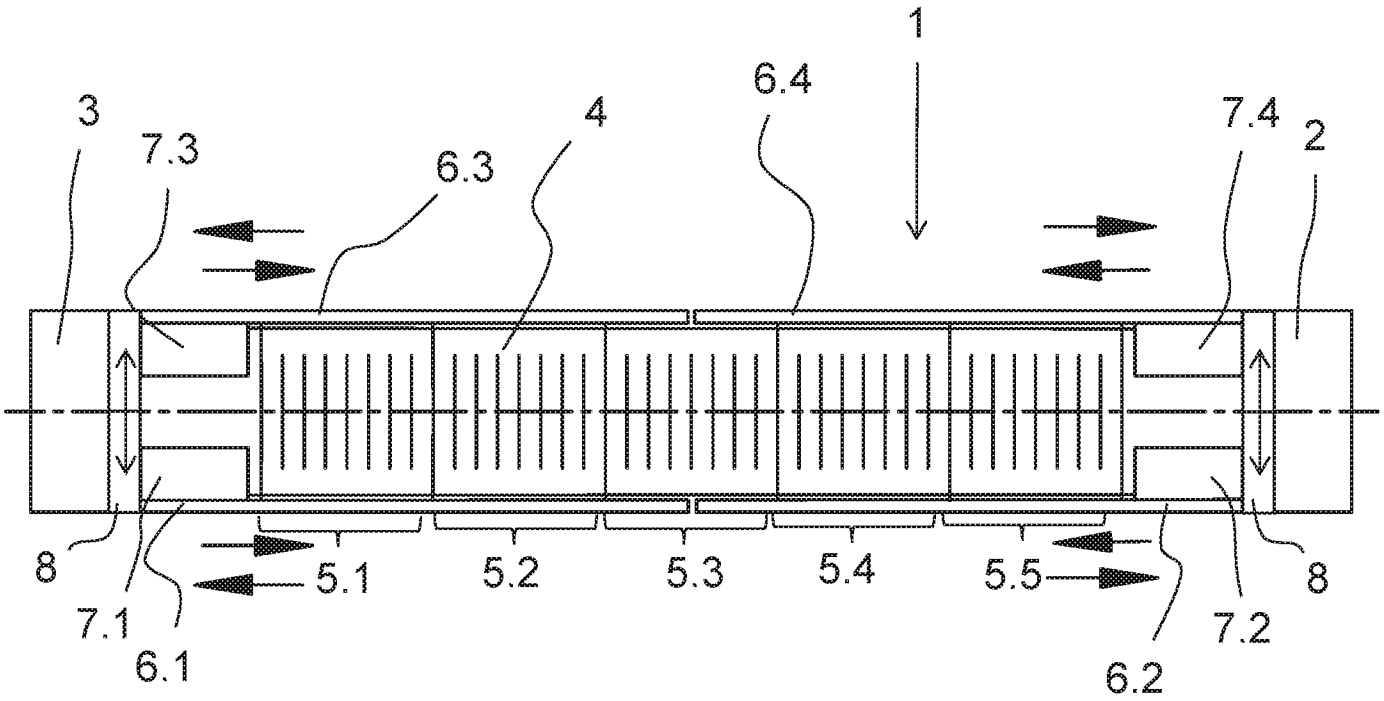
FIG. 4 is a spinning-mill machine in accordance with FIG. 3 with a transfer device.

Through a connection of the sleeve stacks 7.1, 7.3 or 7.2, 7.4, as the case may be, or through a corresponding device that moves sleeves to the other side of the machine, the sleeve stacks 7.1 to 7.4 can also enable the supply of sleeves for both machine sides. This is illustrated in FIG. 4. A spinning-mill machine according to FIG. 3, which features a transfer device 8 at each machine end, is shown there. With the transfer device 8, sleeves can be conveyed from one machine side to the other machine side, as indicated by the double arrow. However, the transfer device can also be arranged in the middle of the spinning-mill machine, where the sleeve transport devices 6.1 to 6.4 end. Similarly, such a transfer device 8 is also possible with other embodiments of the invention, such as those of FIG. 1 or 2. The transfer device 8 can also be provided simply by a deflection of the sleeve transport devices 6.1 to 6.4, such that the sleeves are thus conveyed to the other side.

This invention is not limited to the illustrated and described embodiments. Variations within the scope of the claims, just as the combination of characteristics, are possible, even if they are illustrated and described in different embodiments.

LIST OF REFERENCE SIGNS

1 Spinning-mill machine
2 Drive frame
3 End frame
4 Cross-winding devices
5.1 to 5.5 Sections
6.1 to 6.4 Sleeve transport devices
7.1 to 7.4 Sleeve stacks
8 Transfer device

The invention claimed is:

1. A spinning-mill machine, comprising:

a plurality of cross-winding devices arranged next to each other in a longitudinal direction along opposite machine sides of the spinning-mill machine, each cross-winding device configured to wind yarn onto a sleeve;

the cross-winding devices arranged into a plurality of sections;

a plurality of dedicated sleeve stacks assigned to each machine side and configured to stockpile sleeves;

a plurality of sleeve transport devices configured alongside the cross-winding devices at each of the machine sides, wherein each of the sleeve stacks assigned to each machine side has only one of the sleeve transport devices operationally associated therewith to deliver the sleeves from the sleeve stack to the cross-winding devices of the respective machine side.

2. The spinning-mill machine according to claim 1, wherein each of the sleeve stacks is operationally allocated to a single one of the machine sides for stockpiling empty sleeves for the single machine side.

3. The spinning-mill machine according to claim 1, wherein each of the sleeve transport devices comprises a conveyor belt arranged in a stationary conveying position along the cross-winding devices of one of the machine sides such that each machine side has at least two of the conveyor belts associated therewith.

4. The spinning-mill machine according to claim 3, wherein the conveyor belts are reversibly drivable.

5. The spinning-mill machine according to claim 3, wherein the conveyor belts along each machine side run parallel to each other.

6. The spinning-mill machine according to claim 1, wherein the plurality of sleeve stacks arranged with each machine side are aligned parallel to the machine side.

7. The spinning-mill machine according to claim 1, wherein the plurality of sleeve stacks arranged with each machine side are arranged next to each other on the machine side.

8. The spinning-mill machine according to claim 1, wherein the plurality of sleeve stacks arranged with each machine side are arranged on one or more of a drive frame, and intermediate frame, or an end frame of the machine side.

* * * * *